US005259321A

United States Patent [19]

Pahnke

[11] Patent Number: 5,259,321

[45] Date of Patent: Nov. 9, 1993

[54] PROPELLING CAGE FOR A SUBCALIBER PROJECTILE

[75] Inventor: Klaus D. Pahnke, Solingen, Fed. Rep. of Germany

[73] Assignee: Rheinmetall Gmbh, Düsseldorf, Fed. Rep. of Germany

[21] Appl. No.: 933,188

[22] Filed: Aug. 21, 1992

[30] Foreign Application Priority Data

Aug. 23, 1991 [DE] Fed. Rep. of Germany ..... 4128054

[51] Int. Cl.[5] ..... F42B 14/06

[52] U.S. Cl. ..... 102/521

[58] Field of Search ..... 102/520–523

[56] References Cited

U.S. PATENT DOCUMENTS

| | | | |
|---|---|---|---|
| 3,862,603 | 1/1975 | Kornblith et al. | 102/522 |
| 4,444,113 | 4/1984 | Campoli | 102/521 |
| 5,103,735 | 4/1992 | Kaste et al. | 102/521 |
| 5,157,224 | 10/1992 | Desevaux et al. | 102/520 |

FOREIGN PATENT DOCUMENTS

| | | | |
|---|---|---|---|
| 158828 | 10/1985 | European Pat. Off. | 102/520 |
| 3625730 | 2/1988 | Fed. Rep. of Germany | 102/522 |
| 3704027 | 8/1988 | Fed. Rep. of Germany . | |
| 3904626 | 8/1990 | Fed. Rep. of Germany | 102/521 |
| 3930255 | 3/1991 | Fed. Rep. of Germany . | |
| 2123121 | 1/1984 | United Kingdom . | |

*Primary Examiner*—Harold J. Tudor

*Attorney, Agent, or Firm*—Spencer, Frank & Schneider

[57] ABSTRACT

A subcaliber projectile assembly includes a subcaliber projectile; a supporting member engaging the circumferential surface of the projectile; a guide band supported on the supporting member; and a propelling cage supported on the circumferential surface rearwardly of the guide band. The propelling cage is formed of a plurality of segments mounted in a circular array and each segment is a stamped sheet metal component. Each segment has a bottom portion shaped as a circular cylinder section having opposite longitudinal edges and an underside being in engagement with the circumferential surface of the projectile. Each segment further has two longitudinal ribs connected to the bottom portion along the longitudinal edges and rising radially from the bottom portion. Each segment also has a transverse wall portion extending transversely to the bottom portion and the ribs and interconnecting the ribs with one another at a front-side longitudinal end of the segment.

8 Claims, 2 Drawing Sheets

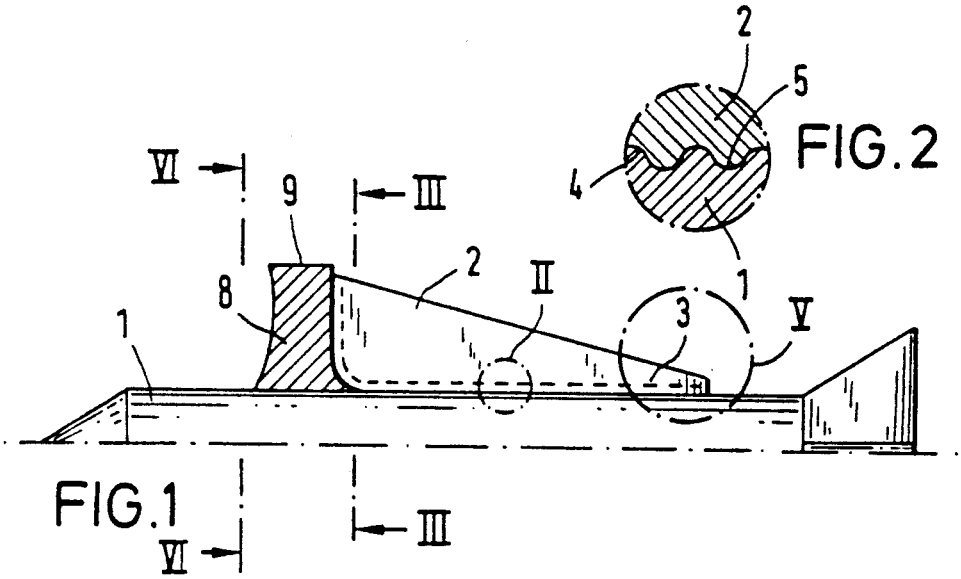
FIG.1
FIG.2
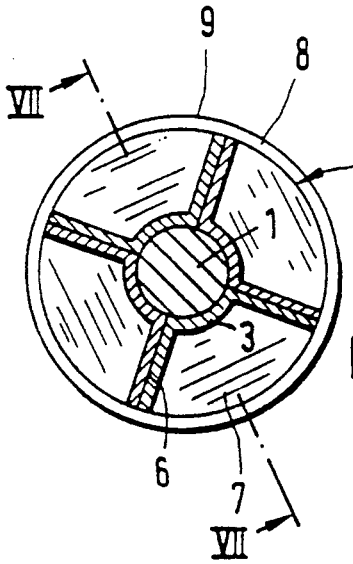
FIG.3
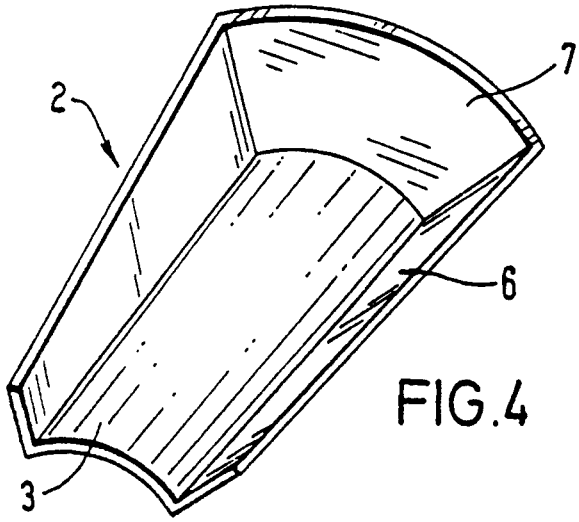
FIG.4

PROPELLING CAGE FOR A SUBCALIBER PROJECTILE

BACKGROUND OF THE INVENTION

The present invention relates to a propelling cage (sabot) for a subcaliber projectile.

The projectile has a guide band near the front end (as viewed in the direction of flight) and a propelling cage formed of axial segments arranged in a circular array. The segments have radially rising and longitudinally extending ribs at their axial abutment faces.

A propelling cage of the above-outlined type, disclosed, for example, in German Offenlegungsschrift (non-examined published application) 37 04 027, has individual segments which are solid components that can be mounted about the subcaliber projectile by means of interengaging teeth. Although the segments are provided with recesses between the ribs in order to reduce the weight of the propelling cage, the segments nevertheless have a considerable volume and weight. Since the ribs serve as reinforcements, a fiber-reinforced plastic of appropriate strength is required as the material for the segments which are consequently expensive to manufacture.

SUMMARY OF THE INVENTION

It is an object of the present invention to provide an improved propelling cage (sabot) of the above-outlined type wherein the segments are of simplified construction and are less expensive to manufacture.

This object and others to become apparent as the specification progresses, are accomplished by the invention, according to which, briefly stated, the subcaliber projectile assembly includes a subcaliber projectile; a supporting member engaging the circumferential surface of the projectile; a guide band supported on the supporting member; and a propelling cage supported on the circumferential surface rearwardly of the guide band. The propelling cage is formed of a plurality of segments mounted in a circular array and each segment is a stamped sheet metal component. Each segment has a bottom-portion shaped as a circular cylinder section having opposite longitudinal edges and an underside being in engagement with the circumferential surface of the projectile. Each segment further ha two longitudinal ribs connected to the bottom portion along the longitudinal edges and rising radially from the bottom portion. Each segment also has a transverse wall portion extending transversely to the bottom portion and the ribs and interconnecting the ribs with one another at a front-side longitudinal end of the segment.

BRIEF DESCRIPTION OF THE DRAWINGS

FIG. 1 is a schematic elevational view of a subcaliber penetrator projectile provided with a propelling cage according to a preferred embodiment of the invention.

FIG. 2 is a sectional view of inset II of FIG. 1.

FIG. 3 is a sectional view along line III—III of FIG. 1.

FIG. 4 is a perspective view from the back end of a segment of the propelling cage of FIG. 1.

DETAILED DESCRIPTION OF THE PREFERRED EMBODIMENT

Figure 5:
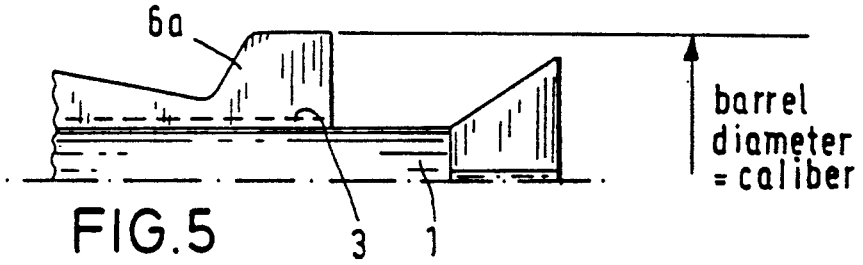
FIG. 5 is a view of the back end of a segment of the propelling cage of FIG. 1.
Figure 6:
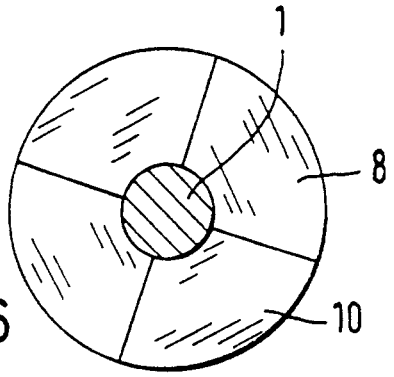
FIG. 6 is a view along line IV—IV of FIG. 4.

In FIGS. 1 and 3 there is illustrated a propelling cage for a penetrator projectile 1. The propelling cage has a plurality of segments 2 which are economically produced punched sheet metal components. FIG. 4 illustrates a single segment 2 in a perspective view. Each segment 2 includes a lower portion 3 that has the shape of a circular cylinder section. The lower portion 3 has means for engagement with the circumference of penetrator projectile 1. The engagement means may be a frictional engagement or a form-locking engagement as shown in FIG. 2. Form-locking engagement may be accomplished by way of grooves 5 arranged in the outer surface of penetrator projectile 1 and grooves 4 that are oriented in the same manner as grooves 5 and are provided in the underface of the lower portion 3. When the segments 2 are installed on projectile 1, grooves 5 are in engagement with the corresponding raised portions defined between grooves 4, whereby the lower portion 3 of each segment 2 is in form-locking engagement with the projectile 1.

The lower portion 3 is connected at each of its longitudinal edges with a rib 6. The radial height of the ribs 6 gradually decreases rearwardly (that is, opposite to the flight direction). The exterior faces of ribs 6 form the axial abutment faces of segments 2, so that in the mounted state of the propelling cage, the circularly arranged segments 2 are in a face-to-face engagement with respective exterior rib faces, as best seen in FIG. 3. Towards the front of segment 2, a radial, essentially trapezoidal wall portion 7 is provided which has arcuate top and bottom edges and which constitutes a one-piece component with the lower portion 3 and the two ribs 6. Portion 3 preferably has a larger wall thickness than mbs 6. The wall portion 7 extends transversely to the ribs 6. Thus, the segments 2 have the general shape of a shovel blade having a convex bottom. Segment 2 has a maximum outer diameter, defined by wall portion 7, which is slightly less than the weapon bore caliber. As an alternative the two ribs 6 are formed at their ends as fins 6*a*, which have the diameter of the caliber.

Figure 7:
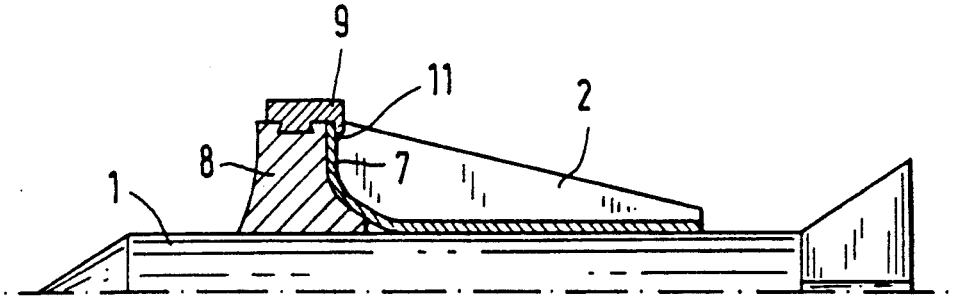
FIG. 7 is a sectional view of FIG. 1 along line V—V of FIG. 3.

As shown in FIG. 1, in front of segments 2, there is disposed a circular supporting member 8 divided in segments 10 which is in engagement with the transverse wall portion 7 of each segment 2 and which is in a form-locking engagement with penetrator projectile I. The form-locking engagement may be accomplished in the manner previously discussed, and as illustrated in FIG. 2. The outer circumference of the supporting member 8 is provided with a guide band 9 and with a seal, as illustrated in FIG. 7.

It will be understood that the above description of the present invention is susceptible to various modifications, changes and adaptations, and the same are intended to be comprehended within the meaning and range of equivalents of the appended claims.

What is claimed is:

1. A subcaliber projectile assembly having a front and a rear as viewed in a direction of projectile flight, the assembly comprising:

(a) a subcaliber projectile having a circumferential surface;

(b) a supporting member surrounding and engaging said circumferential surface;

(c) a guide band supported on said supporting member; and (d) a propelling cage supported on said circumferential surface rearwardly of said guide band, said propelling cage being formed of a plurality of segments mounted in a circular array on said circumferential surface; each said segment being a stamped sheet metal component and each segment including (1) a bottom portion shaped as a circular cylinder section having opposite longitudinal edges; said bottom portion having an underside being in engagement with said circumferential surface;

(2) two longitudinal ribs connected to said bottom portion along said longitudinal edges and rising radially from said bottom portion; and (3) a transverse wall portion extending transversely to said bottom portion and said ribs and interconnecting said ribs with one another at a longitudinal end of the segment; said longitudinal end being oriented towards said front.

2. A subcaliber projectile assembly as defined in claim 1, wherein each said rib of said segment has an external abutment face; the ribs of circumferentially adjoining segments being in a face-to-face engagement with one another at said abutment faces.

3. A subcaliber projectile assembly as defined in claim 1, wherein a radial height of the ribs of said segments decreases rearwardly.

4. A subcaliber projectile assembly as defined in claim 1, wherein the bottom portion of said segments includes means for frictionally attaching said segments to said circumferential surface.

5. A subcaliber projectile assembly as defined in claim 1, wherein the bottom portion of said segments includes means for form-lockingly attaching said segments to said circumferential surface.

6. A subcaliber projectile assembly as defined in claim 1, said supporting member being in engagement with said transverse wall portion of said segments.

7. A subcaliber projectile assembly as defined in claim 1, wherein the longitudinal ribs are formed as fins at a back end of the sabot.

8. A subcaliber projectile assembly as defined in claim 1, wherein the guide band fixes the supporting member and the segments.

* * * * *